United States Patent [19]

Johnson

[11] 4,308,937

[45] Jan. 5, 1982

[54] SELF-ALIGNING CLAMPING APPARATUS

[76] Inventor: Norman A. Johnson, 5325 10th Ave., Delta, B.C., Canada, V4M-1X6

[21] Appl. No.: 100,056

[22] Filed: Dec. 4, 1979

[51] Int. Cl.[3] ..... B61H 7/12

[52] U.S. Cl. ..... 188/43; 104/17 R

[58] Field of Search ..... 188/41, 43, 44, 1 A; 104/17 R; 294/88 R

[56] References Cited

U.S. PATENT DOCUMENTS

| | | | |
|---|---|---|---|
| 2,856,030 | 10/1958 | Snow | 188/43 |
| 3,552,320 | 1/1971 | Traupmann | 104/17 R |
| 3,722,629 | 3/1973 | Totschnig | 188/1 A |
| 3,972,392 | 8/1976 | Johnson | 188/43 |
| 4,236,608 | 12/1980 | Kobelt | 188/43 |

FOREIGN PATENT DOCUMENTS

| | | | |
|---|---|---|---|
| 292279 | 10/1953 | Switzerland | 188/43 |

*Primary Examiner*—Joseph E. Valenza

[57] ABSTRACT

Disclosed herein are novel imporvements in a clamping apparatus adapted to grip the sides of a clamped member and, more specifically, the sides of rails such as those used for cranes and railroads. The clamping apparatus includes a frame adapted for primary movement relative to and substantially parallel with the clamped member, and secondary movement substantially perpendicular to the sides of the clamped member. Secured to the frame, in opposed relation to the clamped member, are lateral guides. A pair of yokes, including clamp guides and lever centering surfaces is slidably mounted in the lateral guides for movement substantially perpendicular to the sides of the clamped member. A pair of clamp levers, having clamping surfaces in opposed relation to the sides of the clamped member, are pivotally mounted intermediate their ends in the pair of yokes. An actuating link is pivotally connected to the other end of each clamp lever. A linear actuator is pivotally mounted in the frame axis substantially parallel with the clamped member. The actuating links are pivotally connected to the linear actuator. In both engaged and released modes of the apparatus, the clamping surfaces and yoke move in the lateral guides to compensate for the secondary movement of the frame and to align the surfaces with the sides of the clamped member. In their retracted position, the clamp levers are centered relative to the clamped member and the clamping surfaces are protected from contact with the clamped member by the clamp guides.

15 Claims, 13 Drawing Figures

SELF-ALIGNING CLAMPING APPARATUS

This invention relates to novel improvements in devices such as those described in my U.S. Pat. No. 3,972,392 and known in the art to which they pertain as rail clamps and storm brakes of the general character of clamping devices which apply substantially equal and opposite forces to opposite sides of a clamped member. Specifically, this invention employs novel means for clamping the sides of rails such that a track-mounted apparatus may be secured to its rails, thus resisting external forces which would otherwise move the apparatus along the rails. Still more specifically, this invention is adapted to secure such machines as ship loaders and unloaders, stackers, reclaimers, gantry cranes, bridge cranes and container cranes to their rails as against wind and operational forces which may from time to time occur. Engagement and release of such clamping devices may be achieved by spring force, electrical force, fluid pressure, manual means, or a combination thereof.

A self-aligning clamping device secured to a track-mounted apparatus and adapted to clamp the sides of a rail must satisfy several requirements. First, the clamping assembly must permit sufficient lateral movement of the clamp with respect to the rail to accommodate the movement of the apparatus wheels on the rail as limited by the tread width between the wheel flanges; the difference between tread width and rail width is often a matter of design to accommodate structural deflection and thermal expansion and contraction. Second, lateral movement of the clamp assembly should not alter the angle at which the clamping surfaces approach the sides of the crane rails. Third, where the clamping surfaces comprise metal serrated shoes of hardness substantially greater than that of the rail, means should be provided to prevent the shoes from draging on the rails when the crane moves along its rails. Fourth, when much movement of the clamping device along the rail is anticipated, the clamp guide surfaces should be removable and replaceable. Fifth, the clamp mechanism should be adaptable to either a narrow profile or a low profile to accommodate variations in space envelope between wheel trucks which arise on various types of track-mounted machinery. Sixth, the clamp mechanism should be adapted to mount either on the underside of a sill beam, or equalizer beam, or on the end of a wheel truck. Seventh, the clamping assembly at the rail should be of narrow cross section such that the opening in a travelled surface in which the rails are embedded, as in the case of a dock facility, does not exceed approximately three times the width of the top of the rail. Finally, remote sensing means should be provided to indicate that the clamp is fully released prior to movement of the apparatus on its rails.

Accordingly, one object of this invention is to provide a clamping apparatus in which lateral movement of the clamping assembly does not alter the alignment of its clamping surfaces with the sides of a clamped member. Yet another object of the invention is to provide a clamping apparatus which is adapted to mounting either on the underside of a sill or equalizer beam or on the end of a wheel truck.

Still another object of this invention is to provide a clamping apparatus in which the clamping portions of the clamping assembly are the only portion thereof in the immediate vicinity of the sides of the clamped member.

Yet another object of this invention is to provide sensing means whereby the released position of the clamping surfaces are indicated at a remote location.

A further object is to provide a clamping apparatus in which the clamping surfaces, when in their released position, are substantially centered with respect to and prevented from dragging on the sides of a clamped member.

Still a further object of this invention is to provide a clamping apparatus wherein replaceable clamping and clamp guide surfaces are externally mounted to facilitate periodic examination and replacement without disassembling the entire clamping assembly.

These and still further objects and advantages of the present invention reside in the details of construction of a preferred embodiment disclosed herein and will be evident to one skilled in the art from a study of the specification and accompanying drawings. Therefore, the preferred embodiment disclosed is merely exemplary and is not intended to detract from the full scope of the invention as set out in the annexed claims.

In the drawings, wherein like numerals refer to like parts:

Figure 1:
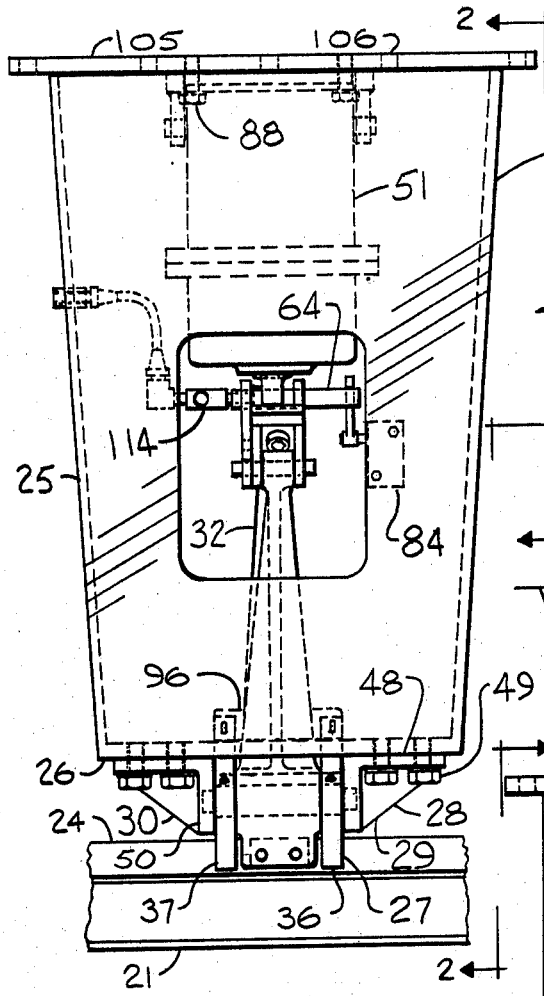
FIG. 1 is a side view of a narrow profile clamping apparatus taken substantially perpendicular to a clamped member.
Figure 2:
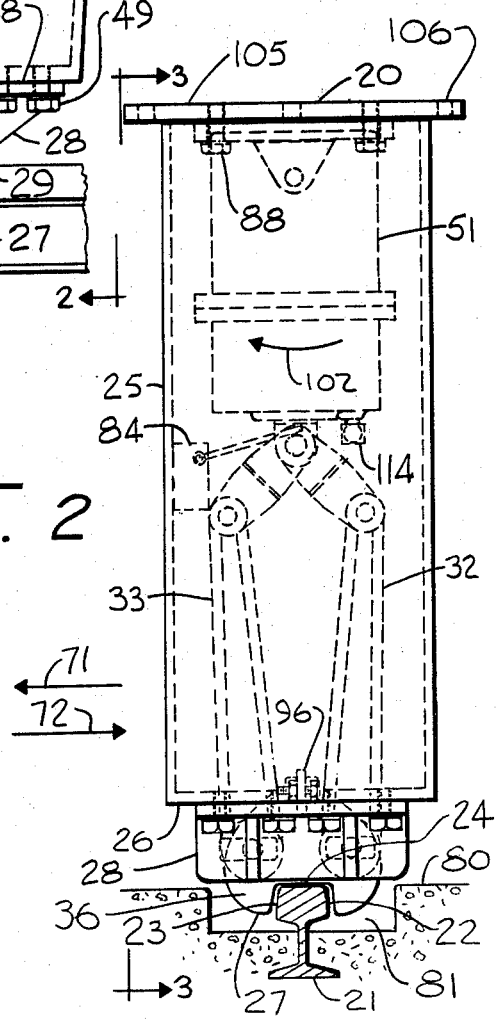
FIG. 2 is an end view of the clamping apparatus taken substantially along plane 2—2 in FIG. 1.
Figure 3:
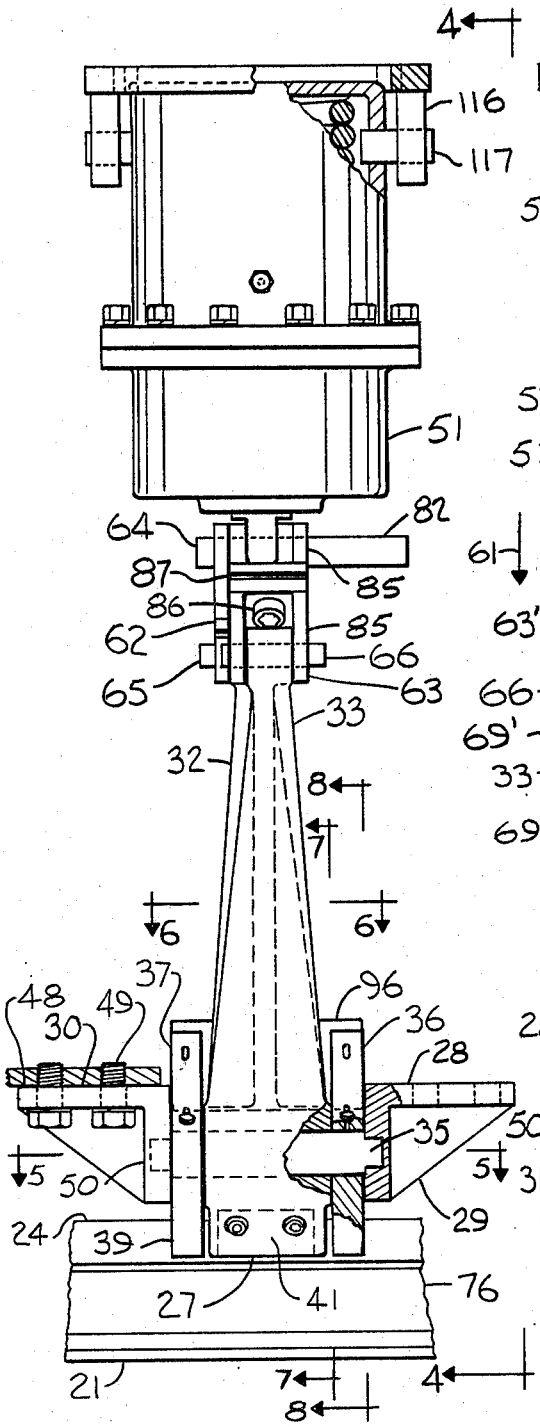
FIG. 3 is an enlarged partially sectioned side view of the structural elements of a spring actuated-pressure released apparatus, excluding an assembly frame, taken substantially along plane 3—3 in FIG. 2.
Figure 9:
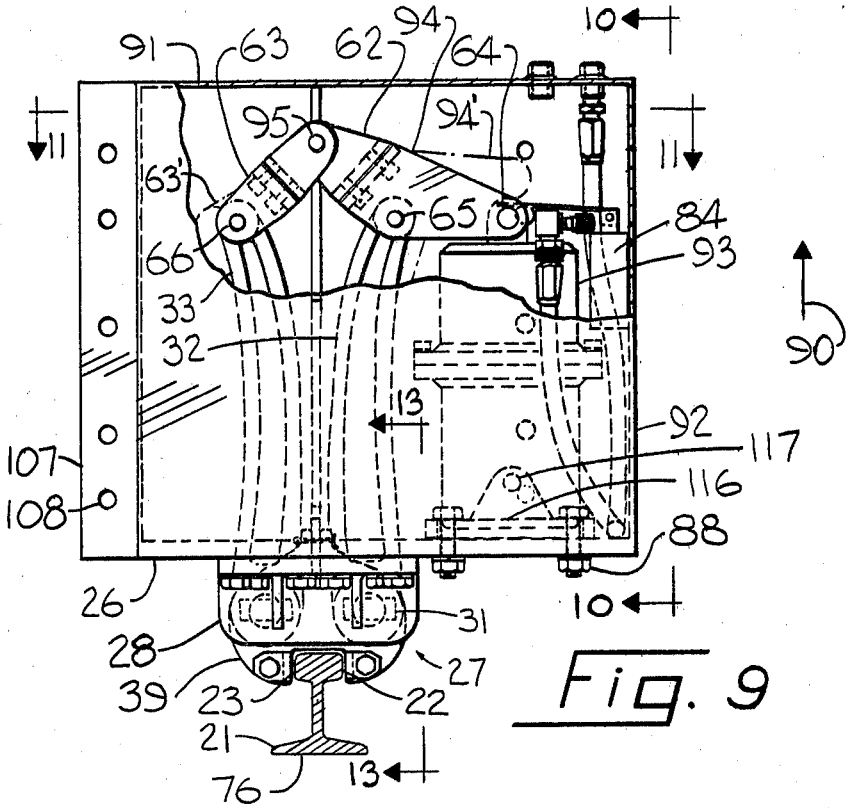
FIG. 9 is an end view of a low profile clamping apparatus taken substantially parallel to a clamped member.
Figure 10:
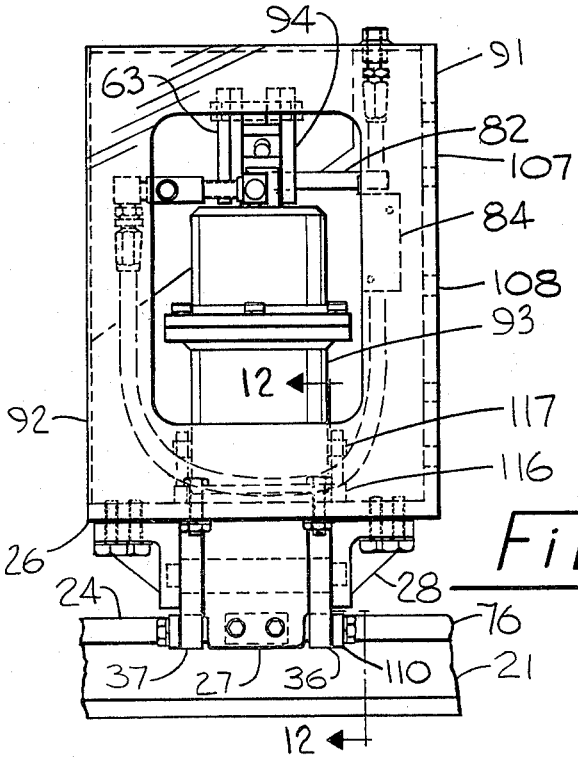
FIG. 10 is a side view of a clamping apparatus taken along plane 10—10 in FIG. 9.
Figure 11:
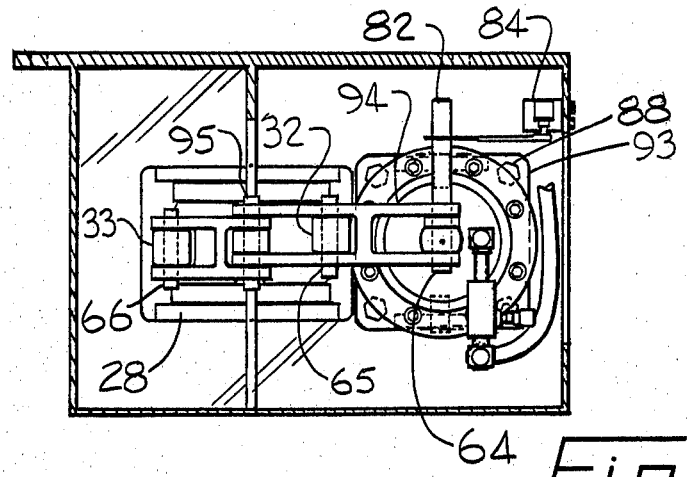
FIG. 11 is a sectional view of a clamping apparatus taken along plane 11 in FIG. 9.
Figure 12:
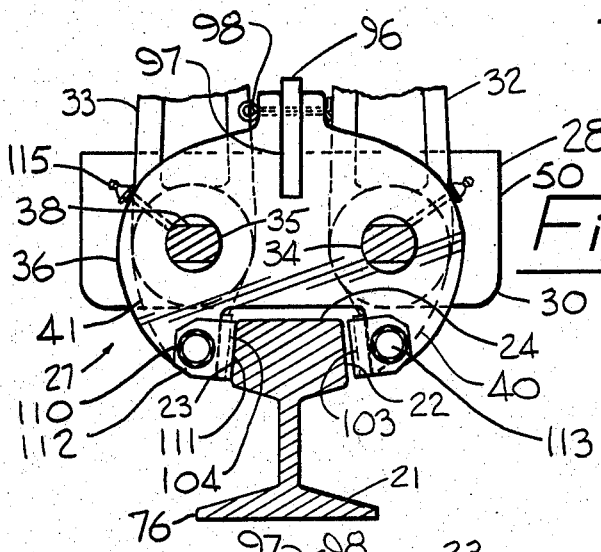
FIG. 12 is a sectional view of a clamping assembly illustrating replaceable clamp guide surfaces, taken substantially along plane 12—12 in FIG. 10.
Figure 13:
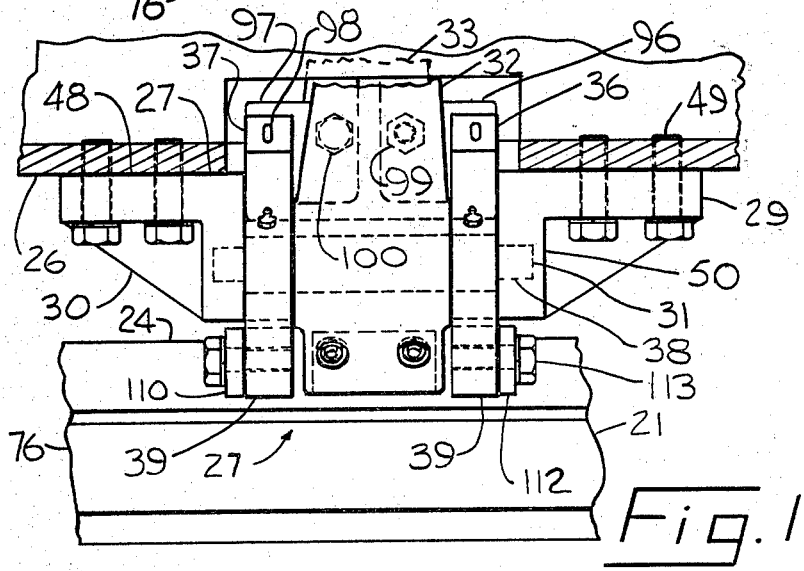
FIG. 13 is a sectional view of a clamping assembly taken along plane 13—13 in FIG. 9.

Referring now to the drawings, FIGS. 1 and 2 illustrate the general structure of a preferred embodiment of a narrow-profile clamping apparatus 20, in accordance with the present invention, in combination with a clamped member 21. FIGS. 9 and 10 illustrate a preferred embodiment of a low-profile clamping apparatus 91, similarly in accordance with the present invention and in combination with member 21. Clamped member 21 includes opposing sides 22 and 23 and lateral surface 24.

Clamping apparatus 20 and 91 include a frame means 25 and 92, respectively, secured to structure which is adapted for movement relative to member 21. Frame means 25 is secured typically to a sill beam or equalizer beam by means of flange 105 and holes 106. Frame means 91 is secured to a wheel truck end by flange 107 and holes 108. In either case, the frame moves along member 21, normally a rail, in either of primary movement directions 74 or 75.

Operatively mounted on the clamped member end 26 of frame means 25 and 92 is clamping assembly 27. With reference to FIGS. 3, 4, 5, 6, 7, 8, 12, and 13, clamping assembly 27 includes lateral guide means 28 comprising a pair of end-brackets 29 and 30 having lateral portion 48, secured to the frame by bolts 49 and slotted holes 31 in perpendicular portion 50. Included in clamping assembly 27 are a pair of clamp levers 32 and 33 pivotally mounted respectively on level pin means 34 and 35. Lever pin means 34 and 35 are mounted in a pair of yoke means 36 and 37 and include flattened ends 38 which extend through yoke means 36 and 37 and are slidably mounted in slotted holes 31 of end-brackets 29 and 30. Yoke means 36 and 37 include clamp guide means 39 which extend along opposing sides 22 and 23 of clamped member 21. Secured to clamping ends 40 and 41 of levers 32 and 33, respectively, are clamping surface means 42 and 43. Clamping surface means 42 and 43 comprise serrated shoes 44 and securing bolts 45 accessible from the exterior area 46 of assembly 27 such that shoes 44 may be removed in direction 47 for periodic inspection or replacement without disassembling assembly 27.

Operatively mounted inside frame means 25 by bolts 88, is spring-set and fluid pressure released linear actuator 51 having trunnion flange 116, trunnion pins 117, cylinder portion 52, piston portion 53 slidably mounted in cylinder portion 52, rod portion 54 secured to piston portion 53 and extending slidably through end 55 of cylinder portion 52, spring chamber 56 on one side, and fluid chamber 57 on the other side of piston portion 53. Seal means 58 and 59 seal interacting surfaces of cylinder portion 52 with piston portion 53 and rod portion 54 respectively. Mechanical compression spring means 60 is operatively mounted in spring chamber 56 such that it imparts a force in direction 61 to piston portion 53.

Pivotally mounted inside frame 92 is linear actuator 93 which actuates in direction 90. Clearly, to one skilled in this art, it is a matter of design choice as to whether linear actuator 93 is identical to actuator 51 or, alternatively, fluid pressure extended and spring retracted, electromechanically extended and retracted by means of gearing and a jack-screw, spring-set and solenoid retracted, or manually set and released by means of a jack screw or lever and pawl. For example, an automatic spring-set and fluid pressure released clamping apparatus may be desired on a gantry crane, whereas manual actuation is more economical and may be desired for a holding device on a conveyor tripper. The fundamental similarity is that the actuator be pivotally mounted in the frame.

In embodiment 20, a pair of actuating links 62 and 63 are pivotally connected at one end by actuating pin means 64 to rod portion 54. The other ends of links 62 and 63 are pivotally connected by pin means 65 and 66 to actuated ends 68 and 69 of clamp levers 32 and 33, respectively. Links 62 and 63 are comprised of link halves 85 secured together by bolts 86. Shims 87 may be added between link halves 85 to adjust the opening between surfaces 42 and 43.

Embodiment 91 employs actuating link 62 and 63, interconnected pivotally at one end by pin 95. Link 62 includes lever portion 94 pivotally connected to rod portion 54 by actuating pin means 64.

Lever centering means 96 comprise bar 97 cradled in each end of yoke means 36 and 37 and secured in place by cotter pins 98. Threaded into bar 97 are adjustable centering bolts 99 and 100, secured in place by jam nuts 101. When linear actuator 51 is retracted, lever 32 is centered against bolt 99 and lever 33 against bolt 100. Adjustment means provided by bolts 99 and 100 accommodate manufacturing tolerances and variations arising from the addition or removal of shims 87 in links 62 and 63.

Figure 4:
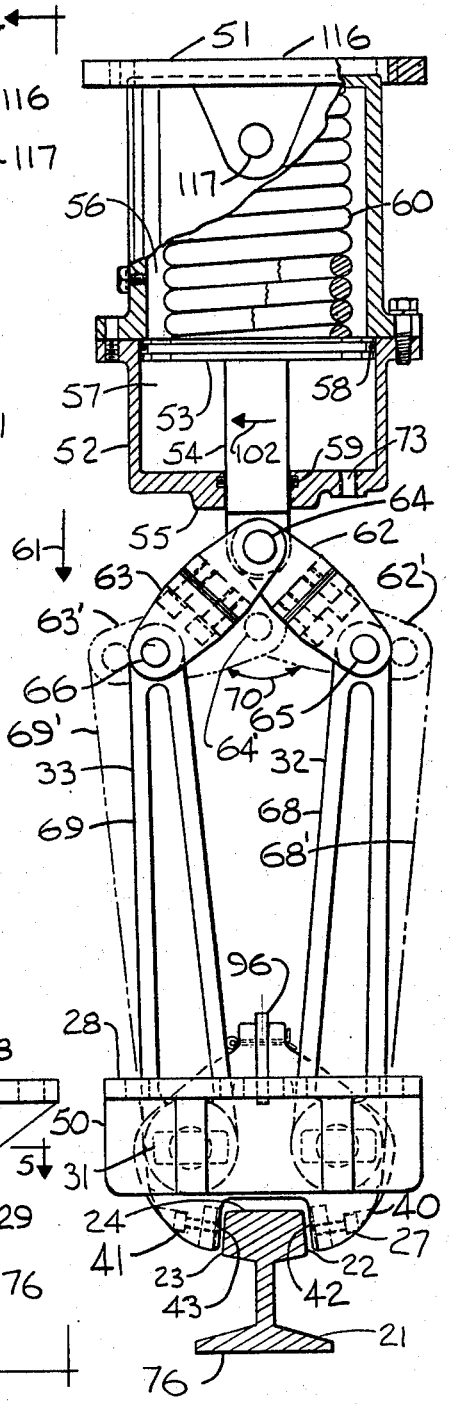
FIG. 4 is an enlarged partially sectioned end view of the structural elements of a clamping apparatus taken substantially along plane 4—4 in FIG. 3.
Figure 5:
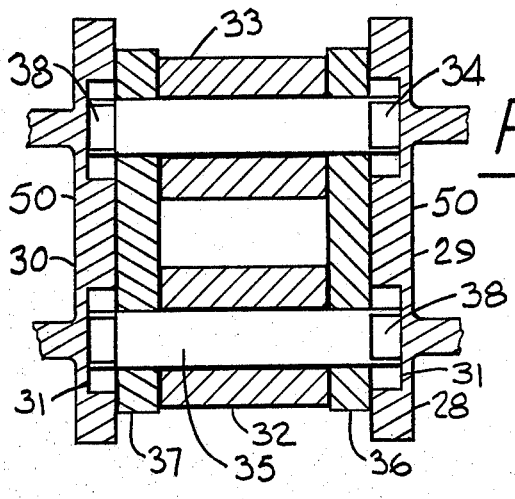
FIG. 5 is a sectional view of the clamping assembly taken substantially along plane 5—5 in FIG. 3.
Figure 6:
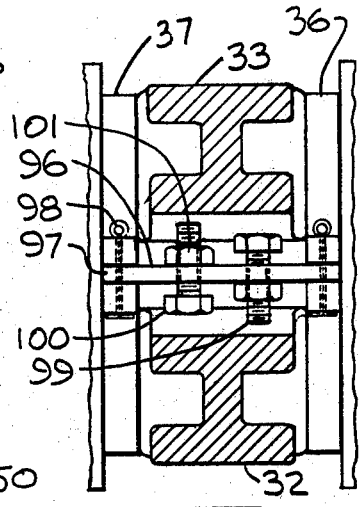
FIG. 6 is a sectional view of the clamping assembly taken substantially along plane 6—6 in FIG. 3.
Figure 7:
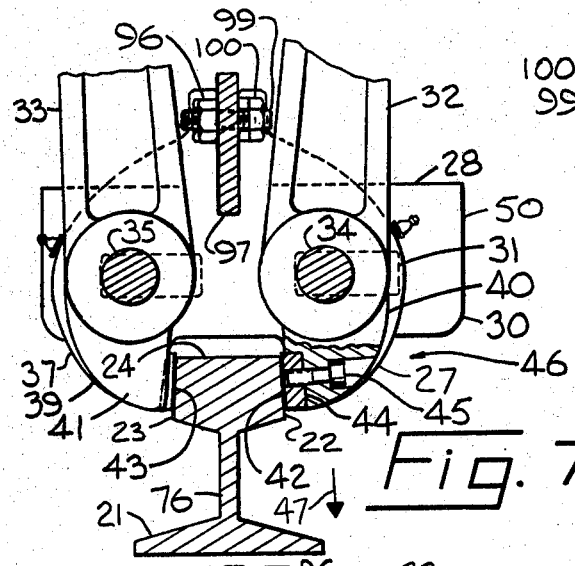
FIG. 7 is a sectional view of the clamping assembly taken substantially along plane 7—7 in FIG. 3.

Turning now to the operation of my present invention, FIG. 4 illustrates piston 53 actuated in spring-set mode by spring 60 into position 53'. Links 62 and 63 and lever ends 68 and 69 are forced into positions 62', 63', 68', and 69'. Likewise, FIG. 9 illustrates rod 54, link 63, and lever 94 in their actuated positions 54', 63', and 94'. In actuated positions 68' and 69' of levers 32 and 33, clamping surface means 42 and 43 bear on sides 22 and 23 of member 21, as illustrated in FIG. 7, thus securing clamping assembly 27 to member 21 subject to the coefficient of friction between surfaces 42 and 43 and member sides 22 and 23. It is accepted in the art that the coefficient of friction is increased above that found for smooth surfaces if surfaces 42 and 43 are serrated and substantially harder than member 21.

With further reference to FIG. 4, it will be evident to one skilled in these arts that, as spring 60 extends, its actuating force decreases. Hence, the actuating force in pin 64 in position 64' will be substantially less than in its fully retracted position. However, it will also be evident that as the angle 70 between links 62 and 63 increases, the resulting forces on lever ends 68 and 69 also increase. It is a matter of design to ensure that the clamping force at surfaces 42 and 43 is equal to or greater than a specified value.

Figure 8:
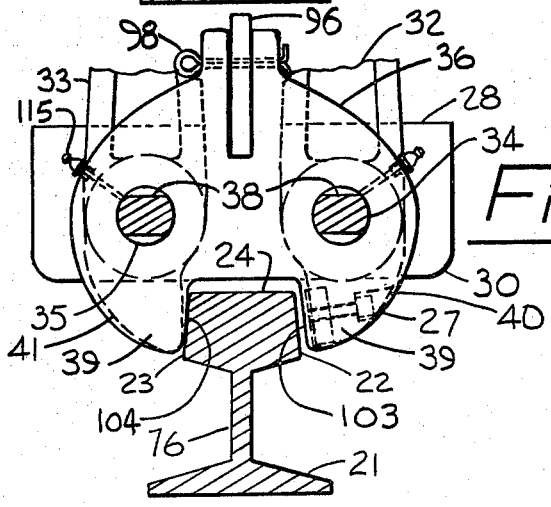
FIG. 8 is a sectional view of the assembly taken along plane 8—8 in FIG. 3.

From FIGS. 1 and 2, it will be evident that secondary movement of frame means 25 laterally in direction 71 relative to member 21 will cause two yoke guide members 39 to contact side 23 of member 21, as illustrated in FIG. 8, such that yoke means 36 and 37 remain stationary in lateral guide means 28, pin ends 38 of pins 34 and 35 sliding in slotted holes 31 of end brackets 29 and 30 to a position typically illustrated in FIG. 7. In like manner, secondary movement of frame means 25 in direction 72 causes yoke guide members 39 to contact side 22 of member 21, yoke means 36 and 37 again remaining stationary with respect to member 21 but moving in direction 71 relative to end-brackets 29 and 30.

It will be evident to one skilled in this art that the angular movement of surfaces 42 and 43 would be substantially relative to the central axis of pin 64, for small movements of yokes 36 and 37 relative to end-brackets 29 and 30, when actuator 51 is fixed to frame 25. However, in my present invention, actuator 51 is pivotally mounted in frame 25 on a pivotal axis parallel to the rail 21. Consequently, the clamping surfaces 42 and 43 align themselves automatically with member sides 22 and 23, causing actuator 51 to pivot slightly in the direction opposite to the lateral movement of frame 25; for the condition shown in FIG. 7, actuator 51 would pivot in direction 102. It is a matter of design to ensure that the self-aligning moment at surfaces 42 and 43 is sufficient to overcome the overturning moment on a given lever assembly created by the force of actuator 21 for a given amount of lateral movement of clamp assembly 27.

Pressurized fluid entering chamber 57 through port 73 is employed to release clamped member 21. In their released position, clamping surfaces 42 and 43 retract behind the guide surfaces 103 and 104 of yoke guide means 39 such that surfaces 42 and 43 do not drag on sides 22 and 23 when frame 25 moves in either of directions 74 or 75 relative to clamped member 21. Clearly, lateral movement of the assembly comprising yoke means 36 and 37, pins 34 and 35, and levers 32 and 33 relative to end-brackets 29 and 30 is initiated by contact of members 39 and member sides 22 and 23.

Lateral movement of frame 25 would cause clamping surfaces 42 and 43 to rotate about pin means 34 and 35. A limit exists for any geometric assembly configuration as to how much lateral movement, say in direction 71, could occur before the top of surface 42 and the bottom of surface 43 would become proud of guide surfaces 103 and 104 on clamp guide means 39. However, in my present invention, centering means 96 causes levers 32 and 33 to align themselves substantially symmetrically with respect to rail 21, thereby ensuring that clamping surfaces 42 and 43 remain behind guide surfaces 103 and 104. It is a matter of design to ensure that the self-aligning moment created by centering means 96 is sufficient to overcome the effects of gravity on the retracted linear actuator 21.

For the specific case where clamped member 21 is a rail 76 having a rail head top corresponding to lateral surface 24 and rail head sides corresponding to member sides 22 and 23, FIG. 2 shows that only clamping ends 40 and 41 of levers 32 and 33 extend below a travelled surface 80 into the recess 81 in which rail 76 is embedded. The narrow openings on either side of the rail permits other wheeled traffic to cross the rail.

For a crane operator at a location remote from the clamping apparatus 20, it is desirable to provide a sensing means which will produce a signal for transmission to the operator. Toward this end, actuating pin 64 is extended as indicated in FIGS. 1, 3, 9, and 10 such that, in its fully retracted position, end 82 actuates a limit sensing device 84 secured to frame 25. Sensing device 84 may be any commonly employed electrical, pneumatic, or hydraulic control device, as required by the circumstances in each particular application of this invention.

FIGS. 9 through 13 illustrate an embodiment wherein the clamping guide means 39 include replaceable L-shaped inserts 110 having first and second portions 111 and 112. Guide surfaces 103 and 104 are on portion 111 and portion 112 includes a mounting hole. Bolt 113 secures blocks 110 to members 39, thus facilitating removal, examination, and replacement without disassembling the entire rail clamp.

It is believed that my invention of a self-aligning clamping apparatus will have been clearly understood from the foregoing detailed description of my now preferred and illustrated embodiments. Various modifications, changes, additions, and equivalents may be resorted to in view of these teachings by one skilled in this art without departing from the spirit of my invention. For instance, frame means 25 and 92 may be of various sizes, shapes, modes of construction, and mounting design. Yoke means 36 and 37 may comprise a single member or several members. A spring-set pressure-released linear actuator 51 may have its spring and fluid chambers on the sides of piston 53 opposite to those illustrated in FIG. 4, actuating pin 64 being disposed further away from actuator 51 than pins 65 and 66 and being pulled toward actuator 51 in the fail-safe clamping mode of apparatus 20. A spring-set pressure-released linear actuator may further employ a directional flow control valve 114 to provide rapid release and controlled engagement. Pins may be secured by cotter pins, nuts, heads, roll pins and many other fastening means. Pins may be lubricated in a variety of means such as by grease fittings 115. Spring means 60 may comprise a single or plurality of springs. Centering means 96 could be fixed or adjustable and an integral part of yoke means 36. Therefore, the present invention is not to be construed as limited to the specific details illustrated and described above, and whereas a choice between variations, modifications, changes, additions and equivalents falling within the true scope of my invention will depend largely upon the circumstances in which it is used, it is my express intention that no limitations be implied and that the hereto annexed Claims be given the broadest interpretation to which the language fairly admits.

The embodiments of the invention in which an exclusive property or privilege is claimed are defined as follows:

1. A self-aligning apparatus in combination with a clamped member having a lateral surface and opposing sides, a frame means in opposed relation to said lateral surface and adapted for primary movement parallel to said clamped member and secondary movement substantially perpendicular to said opposing sides, lateral guide means secured to said frame means in opposed relation to said lateral surface, a pair of lever pin means operatively mounted in yoke means and slidably mounted in said lateral guide means, a pair of clamp levers each pivotally mounted intermediate its ends on one of said pair of lever pin means, each of said clamp levers having at one end a clamping surface in opposed relation to one of said opposing sides, said yoke means including clamp guide means on each side of said clamped member and lever centering means disposed between said clamp levers, a pair of actuating links pivotally interconnected at one end to each other, a linear actuator means pivotally mounted at one end in said frame means about a first axis substantially parallel to said clamped member, each of said actuating links pivotally interconnected at its other end to the other end of one of said clamp levers, said actuating links pivotally interconnected to said linear actuator means on an axis substantially parallel to said first axis, whereby actuation of said linear actuator means impels said clamping surfaces against said opposing sides of said clamped member and slidable movement of said yoke means with respect to said lateral guide means compensates for said secondary movement of said frame means and said linear actuator means moves pivotally to allow said clamping surfaces to align themselves with said opposing sides of said clamped member, and whereby said clamp levers make operative contact with said centering means and said clamping surfaces become disposed substantially symmetrically relative to said clamp guide means when said actuation of said linear actuator means is reversed.

2. A self-aligning clamping apparatus as defined in claim 1, wherein said frame means is adapted to mounting on a sill beam or equalizer beam of a track-mounted apparatus.

3. A self-aligning clamping apparatus as defined in claim 1, wherein said lever centering means includes a member mounted in said yoke means, said member disposed between said clamp levers, said levers being in operative contact with opposite sides of said member when said actuation of said linear actuator is reversed.

4. A self-aligning clamping apparatus as defined in claim 1, wherein said lever centering means include adjustable width means.

5. A self-aligning clamping apparatus as defined in claim 1, wherein said frame means is adapted for securing at the end of a wheeled truck on a track-mounted apparatus.

6. A self-aligning clamping apparatus as defined in claim 1 wherein said linear actuator is mounted substantially in opposed relation to said clamped member, said actuating links pivotally interconnected at one end to each other and to said linear actuator means, actuation of said linear actuator means being on a line falling within an angle substantially symmetrical about a line perpendicular to said lateral surface and passing through said clamped member.

7. A self-aligning clamping apparatus as defined in claim 1, wherein one of said actuating links has a lever portion, said linear actuator means mounted in side-by-side relation to said pair of clamp levers and operatively connected to said linear actuator means acting on a line falling within an angle substantially symmetrical about a line perpendicular to said lateral surface and disposed to one side of said clamped member.

8. A self-aligning clamping apparatus as defined in claim 1, wherein said linear actuator means comprises a cylinder portion and a piston portion having a rod portion extending through one end of said cylinder portion, a spring chamber and a fluid chamber formed on opposite sides of said piston portion, said cylinder portion having trunnion mounting means secured to said frame means.

9. A self-aligning clamping apparatus as defined in claim 1, wherein said linear actuator means comprises a cylinder portion and a piston portion having a rod portion extending through one end of said cylinder portion, a spring chamber formed on the rod side and a fluid chamber on the opposite side of said piston portion, said actuating links pivotally secured to said rod portion by pin means, said pin means being substantially closer to said lateral surface than said other ends of said clamp levers in any actuated position of said linear actuator means, actuation of said pin means being in a direction away from said lateral surface.

10. A self-aligning clamping apparatus as defined in claim 1, wherein said actuating links are pivotally secured to said linear actuator means by actuating pin means, a limit sensing means in opposed relation to said actuating pin means, said limit sensing means indicating release of said clamped member by said clamping surface means.

11. A self-aligning clamping apparatus as defined in claim 1, wherein said lateral guide means comprise a pair of end-brackets having slotted holes, said yoke means including members on opposite sides of said clamp levers, said clamp levers pivotally mounted in said yoke means by said lever pin means, said lever pin means extending through said yoke members and into said slotted holes.

12. A self-aligning clamping apparatus as defined in claim 1, wherein each of said clamping surfaces comprise a serrated shoe of material substantially harder than that of said clamped member, each of said serrated shoes secured to one of said clamp levers from that side of said clamp lever opposite said clamping surface.

13. A self-aligning clamping apparatus as defined in claim 1, wherein each of said actuating links comprise two halves operatively secured together and between which length-adjusting shims are operatively secured.

14. A self-aligning clamping apparatus as defined in claim 1, wherein said clamp guide means include replaceable inserts, said inserts comprising first and second portions substantially perpendicular to each other, said first portion in slidable contact with said clamped member, said second portion having a mounting hole and secured to said yoke means by bolt means.

15. A self-aligning clamping apparatus in combination with a rail having a rail top and two opposing rail sides, a frame means in opposed relation to said rail top and adapted for primary movement parallel to said rail and secondary movement substantially perpendicular to said opposing rail sides, lateral guide end-brackets secured to said frame means in opposed relation to said rail top and having slotted holes on faces substantially perpendicular to said rail top, a pair of clamp levers each having a clamping end and an actuated end, a clamping surface secured to said clamping end of each of said clamp levers in opposed relation to said rail sides, a pair of lever pins operatively mounted in a pair of yoke means and slidable mounted in said slotted holes, said yoke means having guide members extending along said rail sides and lever centering means disposed between said pair of clamp levers, said lever centering means having adjustable width and adapted to center said clamping surfaces with respect to said opposing rail sides, each of said pair of clamp levers pivotally mounted on one of said lever pins, a pair of actuating links pivotally interconnected at one end to each other and each connected as its other end to said actuated end of one of said clamp levers, a linear actuator having a cylinder portion and a rod portion secured to a piston portion slidably mounted in said cylinder portion, said cylinder portion pivotally mounted in said frame means on an axis substantially parallel to said rail, said actuating links pivotally interconnected to said rod portion, whereby extension of said rod portion impels said clamping surfaces against said rail sides and retraction of said rod portion impels said clamp levers against said lever centering means and slidable movement of said yoke means with respect to said lateral guide end-brackets compensates for said secondary movement of said frame means and said linear actuator moves pivotally to permit said clamping surfaces to align themselves with said opposing rail sides.

* * * * *